United States Patent [19]

Meier

[11] 4,131,241

[45] Dec. 26, 1978

[54] STRAND DISPENSING DEVICE

[75] Inventor: Harry F. Meier, Cincinnati, Ohio

[73] Assignee: Alaskaug, Inc., Cincinnati, Ohio

[21] Appl. No.: 833,568

[22] Filed: Sep. 15, 1977

[51] Int. Cl.[2] ..... B65H 59/04

[52] U.S. Cl. ..... 242/156.2

[58] Field of Search ..... 242/156.2, 156, 75.4, 242/75.43, 54 R, 86.7, 99, 155 R, 155 BW, 129.8; 188/166, 167

[56] References Cited

U.S. PATENT DOCUMENTS

| | | | |
|---|---|---|---|
| 1,632,876 | 6/1927 | Bouvier | 242/156.2 |
| 2,163,039 | 6/1939 | Hinricher | 242/156.2 |
| 2,215,651 | 9/1940 | Pierce | 242/156.2 X |
| 2,449,773 | 9/1948 | Hargreaves et al. | 188/166 |
| 2,562,990 | 8/1951 | Peebles | 242/156 X |
| 2,726,828 | 12/1955 | Pashkow | 242/156 |
| 3,056,478 | 10/1962 | Beck | 188/166 X |
| 3,081,957 | 3/1963 | Ven de Bilt | 242/156.2 X |
| 3,139,243 | 6/1964 | Warwick et al. | 242/156.2 |
| 3,223,352 | 12/1965 | Fuller et al. | 242/156.2 |

FOREIGN PATENT DOCUMENTS

| | | | |
|---|---|---|---|
| 502826 | 5/1951 | Belgium | 242/156.2 |

*Primary Examiner*—Stanley N. Gilreath
*Attorney, Agent, or Firm*—John M. Pollaro

[57] ABSTRACT

Disclosed is a device for dispensing strand materials which are stored on a spool, reel, or similar storage apparatus. The strand dispensing device includes a lever actuated, self-contained mechanical brake arrangement having a disk positioned between a plurality of opposed brake pads which are normally urged against the disk by a plurality of springs, thereby preventing rotation of the disk. The disk is connected to the storage apparatus so that the storage apparatus will not rotate unless the disk rotates. A lever actuated wedge separates the brake pads when tension is applied to the strand material, releasing the disk and permitting rotation of the disk and the storage apparatus. When the tension on the strand material is released, the springs urge the brake pads against the disk preventing unwanted unwinding of the strand material.

3 Claims, 4 Drawing Figures

STRAND DISPENSING DEVICE

BACKGROUND OF THE INVENTION

This invention relates generally to strand dispensing devices and more particularly to strand dispensing devices which prevent unwanted unwinding as the strand material is removed from a storage apparatus. Still more particularly, this invention relates to strand dispensing devices having a self-contained mechanical braking system which will remain in the engaged position irrespective of the orientation of the strand dispensing device until tension is applied to the strand material.

There are many instances in which strand material must be dispensed from a storage apparatus to some remote point. For example, a number of manufacturing processes, particularly in the textile industry, require strand material to be withdrawn from a storage apparatus, such as a spool, and fed to a remote point where further processing occurs. For simplicity, and by way of further example and not by way of limitation, the following discussion will be directed toward the use of strand dispensing devices by the utility industries.

The utility industries are faced with the problem of stringing heavy electrical conductors between spaced utility poles. Briefly, the method of stringing conductors between the poles involves the initial stringing of a lightweight flexible line, referred to as a pilot line, over pulleys mounted on the poles. Once the pilot line is extended to the desired length of conductor, a heavier line (called a bull line) is connected to the pilot line and is pulled back over the pulleys through the use of a power winch. The electrical conductor then is connected to the bull line and the bull line reeled in to string the electrical conductor between the utility poles. In some cases, the electrical conductor is light enough to be pulled over the pulleys by the pilot line without the need for the intermediate bull line.

With either approach, however, there are problems with respect to stringing of the pilot line. Usually the pilot line is coiled on a reel and the line is pulled from the reel with the initial stringing. When the reel has been set in motion by pulling the line, the inertia of the reel tends to keep it in motion. As a result, the reel spools out the line even after the pulling has stopped. This problem would prevent the use of a pilot line in many instances where a sagging line would interfere with the vehicular or pedestrian traffic.

In the past, this problem has been solved by providing a friction brake to constantly retard the rotation of the pilot line reel. This approach has eliminated the spewing of the line from the reel but has created a number of new problems. One of these problems is encountered when the pilot line is strung for great distances, for example, up to half a mile. When the weight of the rope and the friction of the pulleys are added to the constant friction of the brake, the resultant retarding force is greater than the force capable of being exerted by an operator. Other problems posed by devices of this type are relatively high costs and undue complexity.

For example, U.S. Patent 3,595,529 issued to W. T. Stull et al. on July 27, 1971 discloses a payout assembly which prevents unwanted unwinding as strand material is removed from a storage reel. While the Stull et al. device works well, it relies on a hydraulic brake system which is relatively complex and costly. Similarly, U.S. Patent 3,258,219 issued to R. T. McLendon on June 28, 1956 teaches a tension payoff mechanism for cable reels which utilizes a hydraulic brake system which is subject to the same cost and complexity drawbacks as the Stull et al. device.

U.S. Patent 3,899,143 issued to R. J. Slezak on Aug. 12, 1975 teaches a tension control device which relies on a pneumatic arrangement to regulate the tension required to remove the strand material from the storage reel. The Slezak device must, however, be oriented such that the brake is actuated by gravity.

U.S. Patents 2,488,492 issued to P. K. Dumbleton on Nov. 15, 1949, 3,069,107 issued to R. F. Hirt on Dec. 18, 1962 and 3,228,624 issued to C. L. Brinkman on Jan. 11, 1966 each teach strand dispensing devices which have mechanical braking systems. In each of these devices, however, gravity is utilized to actuate the braking system and thus the devices must be properly oriented.

While the foregoing patents disclose strand dispensing devices which are intended to prevent unwanted unwinding of the strand material during removal from a storage apparatus, they lack the aspects of the present invention wherein a self-contained mechanical braking system is used to prevent unwanted unwinding of the strand material. The self contained mechanical braking system does not rely on complex and costly hydraulic or pneumatic brake arrangements and is actuated by a mechanical means rather than by gravity. This latter aspect permits the present invention to be utilized irrespective of its orientation and renders the present device capable of being embodied in a portable form for use in relatively inaccessible locations.

It is, therefore, an object of the present invention to provide a device having a self-contained mechanical braking system which will be engaged irrespective of the orientation of the strand dispensing device.

It is a further object of the present invention to provide a strand dispensing device which will prevent unwanted unwinding as the strand material is removed from a storage apparatus.

These and other objects of the present invention will be readily apparent when considered in reference to the following description and claims and when taken in connection with the attached drawings to which they relate.

SUMMARY OF THE INVENTION

According to the present invention, a reel or similar storage apparatus for strand material is mounted on a strand dispensing device. The storage apparatus is connected to a disk so that rotation of the disk and storage apparatus are coordinated. The disk is disposed between a plurality of opposed brake pads which are urged against the disk by springs. The force developed by the springs is sufficient to prevent rotation of the disk under normal operating conditions.

The strand material is fed from the storage apparatus around a guide roller which is located at one end of a lever. The other end of the lever is connected to a wedge block. As tension is applied to the strand material, the lever is displaced, causing the wedge blcok to pry the opposing brake pads apart. As the wedge separates the opposing brake pads, the disk and storage reel become free to rotate, thereby permitting the strand material to be pulled from the storage apparatus. When tension is released, the brake pads are urged against the disk, stopping rotation of the storage apparatus, thereby preventing unwanted unwinding of the strand material.

DESCRIPTION OF THE INVENTION

Figure 1:
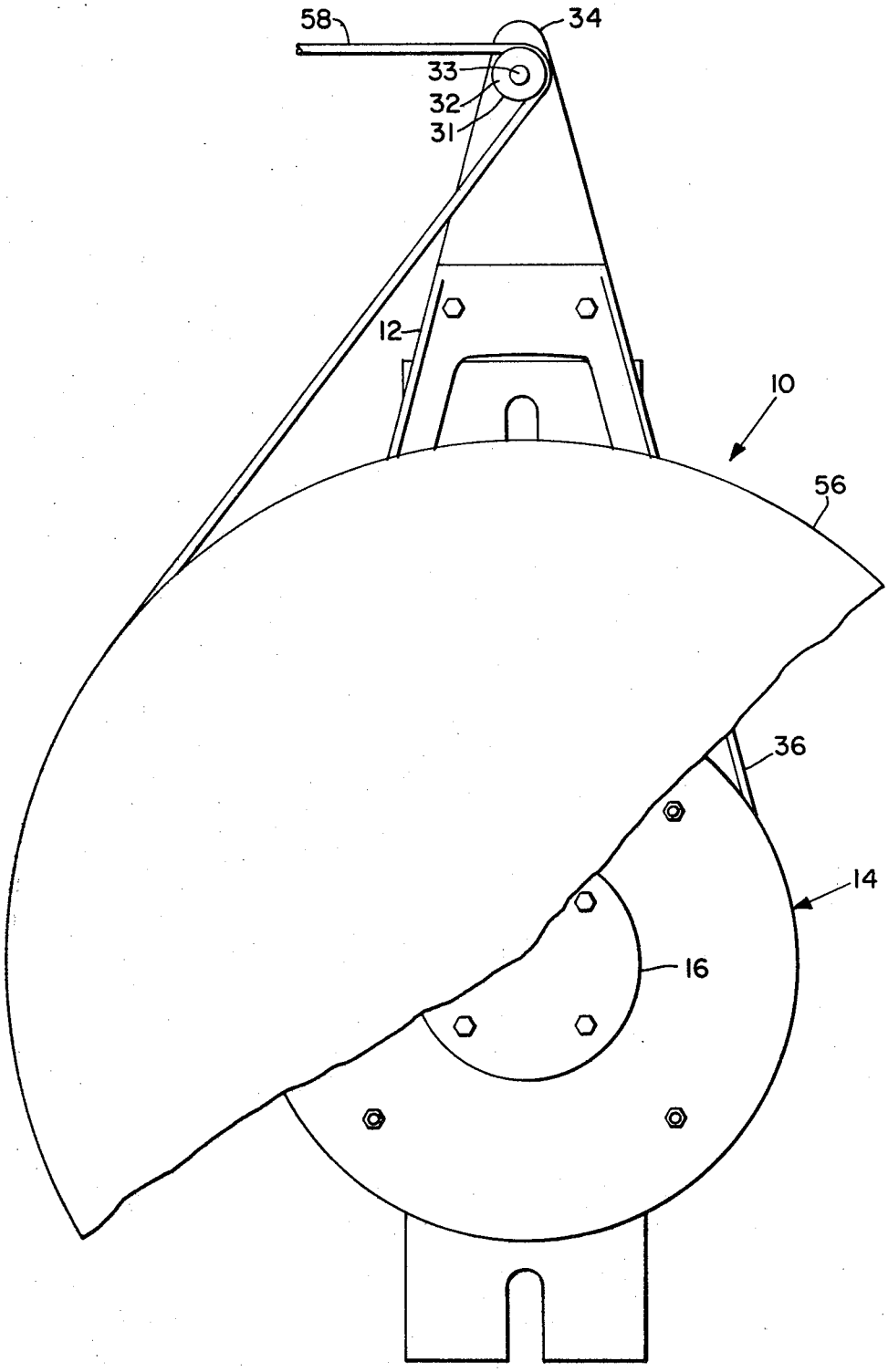
FIG. 1 is a front view of the strand dispensing device of the present invention showing the storage apparatus partially cut away.

Referring now to the drawings, there is shown a preferred embodiment of the invention as it would be used to dispense strand materials such as rope, cable, or wire in a manner utilized by the utility industries as hereinbefore described. As used herein, the term "strand material" refers to any material which is flexible and long relative to its thickness and which is stored by wrapping around a reel, spool, or similar storage apparatus from which the strand material is eventually dispensed.

Figures 2, 3:
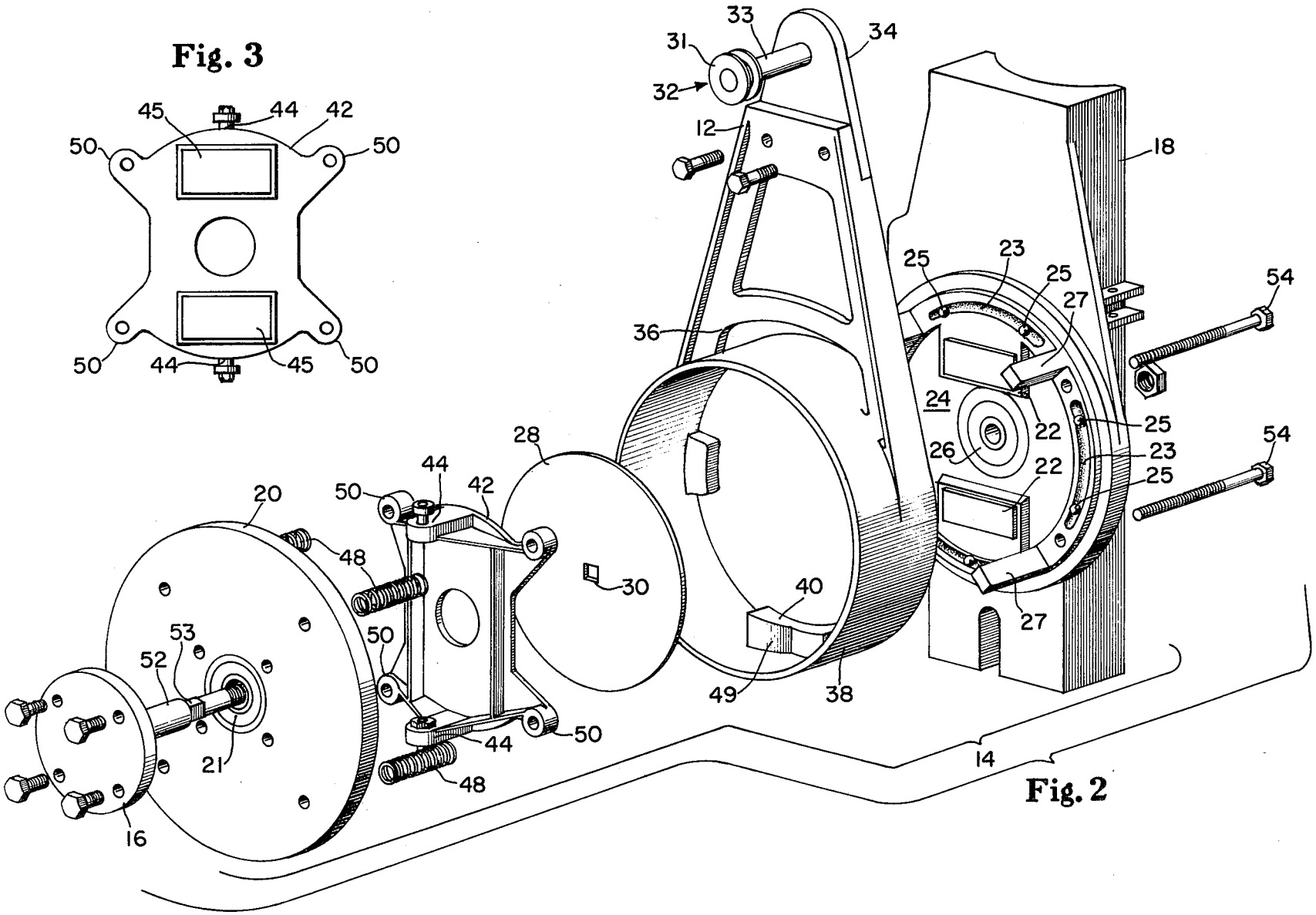
FIG. 2 is an exploded view of the strand dispensing device of the present invention.
FIG. 3 is a front view of second pad support element.
Figure 4:
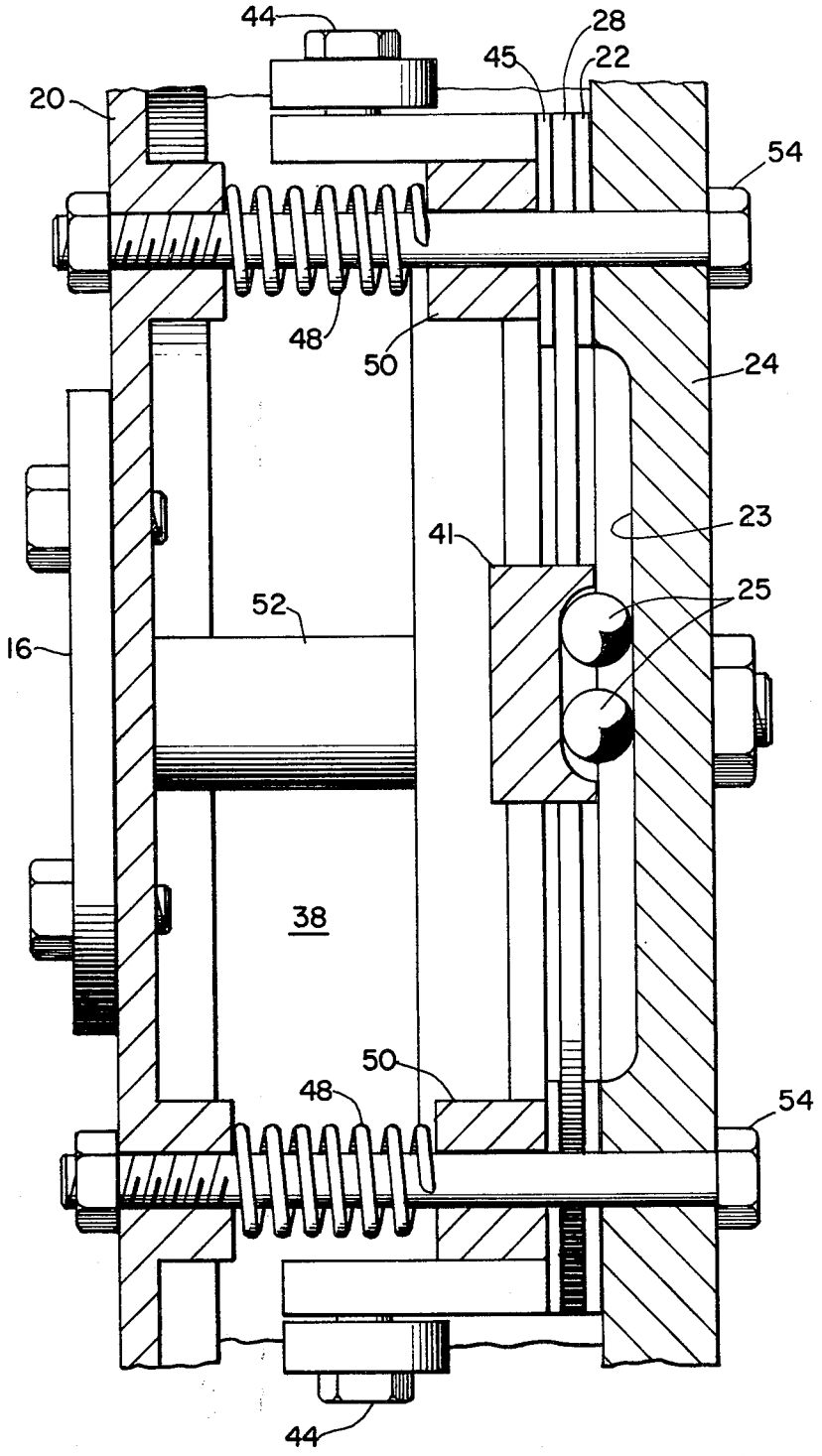
FIG. 4 is a side view of the strand dispensing device of the present invention taken along section 4—4 of FIG. 1.

FIG. 1 shows the strand dispensing device 10 as basically comprising a lever 12, a brake housing portion 14 and a strand material storage apparatus support means 16. Each of these components is more clearly seen in FIG. 2 which is an exploded view of strand dispensing device 10. Referring to FIG. 2, it can be seen that brake housing portion 14 has a first pad support element 18 supporting a plurality of first brake pads 22 fixedly positioned on innersurface 24 of first pad support element 18. A bearing 26 is centrally located in first pad support element 18 and is preferably of the self aligning type as is well known. First pad support member 18 has a plurality of arcuate notches 23 which are cut in innersurface 24 and receive ball bearings 25 such that ball bearings 25 project above innersurface 24 as shown in FIGS. 2 and 4. Stops 27 are projections which are rigidly affixed to innersurface 24. First brake pads 22 may be of any convenient size or material as is well known to those skilled in the brake lining arts. In the preferred embodiment, rectangular strips approximately 2 inches by 4 inches of brake lining material were used with satisfactory results. The size of first brake pads 22 may be varied to provide greater braking capacity if necessary.

Guide 32 is affixed to outer end 34 of lever 12, while inner end of lever 12 is affixed to wedge support 38. In the preferred embodiment, a grooved roller 31 rotatably mounted on shaft 33 was used and found to be satisfactory as guide 32. Wedge support 38 rests on ball bearings 25 and is free to rotate with respect to first pad support element 18. Wedge support 38 may be made to engage ball bearings 25 in many ways which will suggest themselves to one skilled in the mechanical arts. For example, referring to FIGS. 2 and 4, a plurality of circumferentially spaced elements 41 (only one shown in FIGS. 2 and 4) may be affixed to wedge support 38 and positioned so as to coincide with arcuate notches 23 and so as to contact stops 27. For example, elements 41 are preferably circumferentially spaced and project inward from wedge support 38. In this preferred arrangement, stops 27 are located within the periphery of wedge support 38. Two wedge blocks 40 (only one shown in FIG. 2) are fixedly attached to wedge support 38 and may take a variety of shapes and configurations. As shown in FIG. 2, wedge block 40 having a surface 49 shaped to form a "V" configuration was used in the preferred embodiment and found to perform satisfactorily. The steeper the incline of the "V", the greater the force that must be applied to lever 12 to rotate wedge blocks 40. In the preferred embodiment, a slope 45° from the horizontal was used with good results.

Second pad support element 42 has two outwardly projecting protuberances 44 which are aligned with and rest on surface 49 of wedge blocks 40. As seen in FIG. 3, second pad support element 42 further, has two second brake pads 45 fixedly attached thereto such that first and second brake pads 22 and 45 respectively are in face-to-face relationship. Second brake pads 45 are of the same material and construction as first brake pads 22 as hereinbefore described. A plurality of springs 48 are in contact with arms 50 of second pad support element 42. Springs 48 abutt against cover plate 20 and urge second pad support element 42 toward first pad support element 18. Cover plate 20 has a bearing 21 centrally disposed therein which may be of the self-aligning type and is affixed to wedge support 38 in a manner to be described.

Brake disk 28 is disposed between first brake pads 22 and second brake pads 45. Brake disk 28 is manufactured from a structural grade steel as is well known in the prior art and has a centrally disposed aperture 30 therein. Springs 48 urge second brake pads 45 toward first brake pads 22 such that brake disk 28 is clamped between them with a force sufficient to prevent rotation of brake disk 28 under normal operating conditions. In the preferred embodiment, springs developing approximately 50 pounds of force when compressed ½ inch were used and found to give satisfactory results.

First pad support element 18, brake disk 28, wedge support element 38, second pad support element 42 and plate 20 are all aligned with support shaft 52 which passes through each of the foregoing elements. Support shaft 52 is free to rotate with respect to all of the aforementioned elements except brake disk 28. Brake disk 28 and support shaft 52 are joined so that rotation of support shaft 52 cannot take place without rotation of brake disk 28. In the preferred embodiment, shaft 52 was provided with a keyed poerion 53 which mated with aperture 30 in brake disk 28, thereby preventing differential rotation between shaft 52 and brake disk 28.

Each of the elements of strand dispensing device 10 may be made from any suitable material such as structural grade steel, aluminum, or other suitable materials as will suggest themselves to one skilled in the art. Further, the foregoing elements are joined together and held in place by any suitable means such as by bolts 54 passing through support 18, arms 50 of support 42, springs 48 and attached to cover plate 20; with wedge support 38 surrounding bolts 54 and bolts 54 passing radially outwardly of the periphery of disk 28 as shown in FIG. 4.

In operation, a spool 56 is affixed to support means 16. The strand material 58 which is to be dispensed is fed to guide 32 which directs the strand material 58 to the desired location. To dispense the strand material, tension is applied to strand material 58, causing guide member 32 and upper end 34 of lever 12 to be displaced. Displacement of upper end 34 causes wedge support 38 to rotate until wedge support 38 comes into contact with stops 27. Ball bearings 25 move in arcuate notches 23, thereby reducing friction between first pad support element 18 and wedge support 38. Rotation of wedge support 38 causes a displacement of wedge blcoks 40 which in turn causes protuberances 44 to move outwardly in the "V" configured surface 49 of wedge block 40. As protuberances 44 move outwardly springs 48 are compressed and second brake pads 45 move away from first brake pads 22. The space created between first pads 22 and second pads 45 permits disk 28, and thus support shaft 52 and spool 56 to rotate freely causing strand material 58 to be dispensed. The amount of tension that must be applied to strand material 58 must be sufficient to compress springs 45 and to rotate wedge blocks 40. The angle of "V" configured surface 49 of wedge blocks 40 will affect the amount of tension required. A gentler angle will require less tension.

When tension is released from the strand material, the springs 48 urge second pad support element toward first pad support element, causing first and second pads 22 and 45 respectively to press against brake disk 28, thereby arresting rotation of disk 28 and support shaft 52, thus preventing unwanted unwinding of strand material 58. The force of springs 48 on second pad support element 42 also causes protuberances 44 to act against wedge blocks 40. This action forces protuberances 44 to the apex of the "V" configuration of surface 49, thereby causing lever 12 to return to a neutral position irrespective of the orientation of strand dispensing device 10.

It will be understood that the foregoing description is of the preferred embodiment of the invention and is therefore merely representative. There are many variations and modifications of the present invention in light of the foregoing teachings. It is to be understood that within the appended claims, the invention may be practiced otherwise than as specifically described.

What is claimed is:

1. A strand dispensing device comprising:

a support means for supporting a storage apparatus for strand material; said support means being selectively rotatable;

a self-contained mechanical brake means affixed to and cooperating with said support means to selectively prevent rotation of said support means; and a lever means engagably affixed to said mechanical brake means for guiding said strand material and for engaging and disengaging said mechanical brake means; said brake means having:

a first brake pad fixedly attached to a stationary first pad support means;

a second brake pad fixedly attached to a non-rotatably fixed second pad support means, said first and second brake pads being in face-to-face relationship;

a brake disk disposed between said first and second brake pads, said brake disk being affixed to said support means for supporting a storage apparatus for strand material;

a resilient means for urging said second pad support means toward said first pad support so as to engage said brake disk with said first and second brake pads; and a wedge means fixedly attached to said lever means for separating said first and second brake pads, said wedge means having a wedge support rotatably mounted on said first pad support means and fixedly attached to said lever means, and a plurality of wedge blocks fixedly attached to said wedge support and engaging said second pad support means.

2. The device of claim 1, wherein said wedge blocks having a surface shaped into a "V"-notched configuration.

3. The device of claim 2, wherein said second pad support means has a plurality of outwardly projecting protuberances which are in movable contact with said wedge blocks.

* * * * *